US010335800B2

(12) United States Patent
Permi et al.

(10) Patent No.: US 10,335,800 B2
(45) Date of Patent: Jul. 2, 2019

(54) METHOD FOR CONTROLLING A MINERAL MATERIAL PROCESSING PLANT AND A MINERAL MATERIAL PROCESSING PLANT

(71) Applicant: Metso Minerals, Inc., Helsinki (FI)

(72) Inventors: Sami Permi, Vesilahti (FI); Juho Tirranen, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 460 days.

(21) Appl. No.: 14/437,999

(22) PCT Filed: Oct. 23, 2013

(86) PCT No.: PCT/FI2013/051002

§ 371 (c)(1),
(2) Date: Apr. 23, 2015

(87) PCT Pub. No.: WO2014/064336

PCT Pub. Date: May 1, 2014

(65) Prior Publication Data

US 2015/0290654 A1 Oct. 15, 2015

(30) Foreign Application Priority Data

Oct. 26, 2012 (FI) ..... 20126110

(51) Int. Cl.
*B02C 25/00* (2006.01)
*B02C 21/02* (2006.01)

(52) U.S. Cl.
CPC ..... *B02C 25/00* (2013.01); *B02C 21/026* (2013.01)

(58) Field of Classification Search
CPC ..... B02C 25/00; B02C 21/02; B02C 21/026
(Continued)

(56) References Cited

U.S. PATENT DOCUMENTS 3,942,727 A 3/1976 Fahlstrom et al.
4,909,449 A 3/1990 Etheridge
(Continued)

FOREIGN PATENT DOCUMENTS

JP H05-251 A 1/1993
JP H05-04053 A 1/1993
(Continued)

OTHER PUBLICATIONS

Japanese Office Action for JP Patent Application No. 2015-538519, dated Aug. 18, 2017.
(Continued)

*Primary Examiner* — Faye Francis
(74) *Attorney, Agent, or Firm* — Andrus Intellectual Property Law, LLP

(57) ABSTRACT

A mineral material processing plant and a method for controlling thereof. The mineral material processing plant includes at least one motor, at least one actuator, a control system, an arrangement for holding the operating speed of the at least one actuator substantially unchanged. The control system is configured to control the processing plant in such a way that a change of amount and/or quality of material arriving to be processed is recognized and in response to the recognized change of amount and/or quality of the material arriving to be processed, the load of a motor is recognized, and in response to the recognized load of the motor, the running speed of the motor or motors of the mineral material processing plant is increased or decreased so that the operating speed of at least one actuator is held substantially unchanged.

11 Claims, 3 Drawing Sheets

(58) Field of Classification Search
USPC ..... 241/36
See application file for complete search history.

(56) References Cited

U.S. PATENT DOCUMENTS

| | | | |
|---|---|---|---|
| 2005/0173570 | A1 | 8/2005 | Tanaka et al. |
| 2007/0131807 | A1 | 6/2007 | Umeda et al. |
| 2009/0294560 | A1 | 12/2009 | Yamaguchi et al. |
| 2011/0077821 | A1 | 3/2011 | Yamaguchi et al. |

FOREIGN PATENT DOCUMENTS

| | | | |
|---|---|---|---|
| JP | H08-299821 | A | 11/1996 |
| JP | 2005-349278 | | 12/2005 |
| JP | 2012-81369 | | 4/2012 |
| WO | 2004/011159 | A1 | 2/2004 |
| WO | 2009156585 | A1 | 12/2009 |

OTHER PUBLICATIONS

PCT Search Report and Written Opinion dated Feb. 25, 2015.
Finnish Office Action dated Aug. 26, 2013.
Japanese Office Action for JP Patent Application No. 2015-538519, dated Apr. 26, 2018.
Decision to Grant a Patent for Japanese Patent Application No. 2015-538519 dated Dec. 6, 2018.

METHOD FOR CONTROLLING A MINERAL MATERIAL PROCESSING PLANT AND A MINERAL MATERIAL PROCESSING PLANT

CROSS-REFERENCE TO RELATED APPLICATIONS

This application claims priority to PCT/FI2013/051002, filed. Oct. 23, 2013, and published in English on May 1, 2014 as publication number WO 2014/064336, which claims priority to FI Application No. 20126110, filed Oct. 26, 2012, incorporated herein by reference.

FIELD OF INVENTION

The invention relates to a method for controlling a mineral material processing plant and to a mineral material processing plant. In particular, but not exclusively, the invention relates to a mobile mineral material processing plant and to controlling thereof.

BACKGROUND OF THE INVENTION

Mineral material, such as stone, is retrieved to be crushed from the ground either by exploding or by digging. Mineral material may also comprise natural stone, gravel and construction waste. Both mobile crushers and fixed crusher applications are used for crushing. The material to be crushed is fed with an excavator or a wheel loader into a feed hopper of the crusher, from where the material to be crushed falls into the jaws of the crusher, or a feeder or a feeder device transfers the stone material towards the crusher.

A mineral material processing plant comprises on or more crushers and/or screens and possibly further devices such as conveyors. The processing plant may be fixed or mobile. In particular mobile processing plants are used in urban surroundings in processing recyclable material such as construction waste.

It is endeavored to utilize the capacity of a processing plant economically fully in such a way that the crusher is loaded continuously with a large crushing power while the used crushing power is directed to producing a planned product distribution. The power needed by the actuators of the processing plant is produced with a motor, for example a diesel motor, the rotating speed of which determines the energy consumption of the motor.

An objective of the invention is to provide a mineral material processing plant that may be used energy-efficiently An objective of the invention is to provide a mineral material processing plant that may be used with various capacities An objective of the invention is to enable a crushing or other processing time as long as possible.

SUMMARY

According to a first aspect of the invention there is provided a method for controlling a mineral material processing plant, the method comprising

- recognizing a change of amount and/or quality of material arriving to be processed;
- in response to the recognized change of amount and/or quality of the material arriving to be processed, recognizing the load of a motor; and
- in response to the recognized load of the motor, increasing or decreasing the running speed of the motor or motors of the mineral material processing plant so that the operating speed of at least one actuator is held substantially unchanged.

Preferably said at least one actuator, the operating speed of which is held substantially unchanged, is a crusher or a screen.

Preferably at the same time, as the operating speed of at least one actuator is held substantially unchanged, the operating speed of at least one conveyor of mineral material changes in response to the increasing or decreasing of the running speed of the motor.

Preferably the running speed of the motor is decreased or increased in steps.

Preferably the running speed of the motor is decreased or increased steplessly.

Preferably the running speed of the motor is decreased or increased to a predetermined running speed.

Preferably the operating speed of said at least one actuator is held substantially unchanged by ascertaining a sufficient volume flow of hydraulics to said at least one actuator.

Preferably the sufficient volume flow of hydraulics to said at least one actuator is ascertained with a variable-capacity motor or with a pump.

Preferably said recognizing the load of the motor is carried out automatically and/or continuously.

According to a second aspect of the invention there is provided a mineral material processing plant comprising

- at least one motor;
- at least one actuator; and
- a control system;

wherein the mineral material processing plant further comprises

- an arrangement for recognizing a change of amount and/or quality of material arriving to be processed; and
- an arrangement for holding the operating speed of said at least one actuator substantially unchanged; and in that
- the control system is configured to control the processing plant according to a method according to the first aspect of the invention.

Preferably said at least one actuator is a crusher and/or screen.

Preferably the mineral material processing plant comprises an arrangement for changing the operating speed of at least one conveyor of mineral material in response to increasing or decreasing the running speed of the motor at the same time as the operating speed of at least one actuator is held substantially unchanged.

Preferably the mineral material processing plant is one of the following; a fixed plant, a track-based plant, a wheel-based plant.

Preferably that the arrangement for holding the operating speed of said at least one actuator substantially unchanged comprises an arrangement for ascertaining a sufficient volume flow of hydraulics to said at least one actuator.

Preferably the arrangement for holding the operating speed of said at least one actuator substantially unchanged comprises a variable-capacity motor or a pump.

According to a third aspect of the invention there is provided a control system for controlling a mineral material processing plant, the control system being configured to control a processing plant according to a method according to the first aspect of this invention.

According to a fourth aspect of the invention there is provided a computer program comprising computer executable program code that when executed causes a computer to execute a method according to the first aspect of this invention.

Different embodiments of the present invention will be illustrated or have been illustrated only in connection with some aspects of the invention. A skilled person appreciates that any embodiment of an aspect of the invention may apply to the same aspect of the invention and other aspects

BRIEF DESCRIPTION OF THE DRAWINGS

The invention will now be described, by way of example, with reference to the accompanying drawings, in which.

DETAILED DESCRIPTION

In the following description, like numbers denote like elements. It should be appreciated that the illustrated figures are not entirely in scale, and that the figures mainly serve the purpose of illustrating embodiments of the invention.

Figure 1:
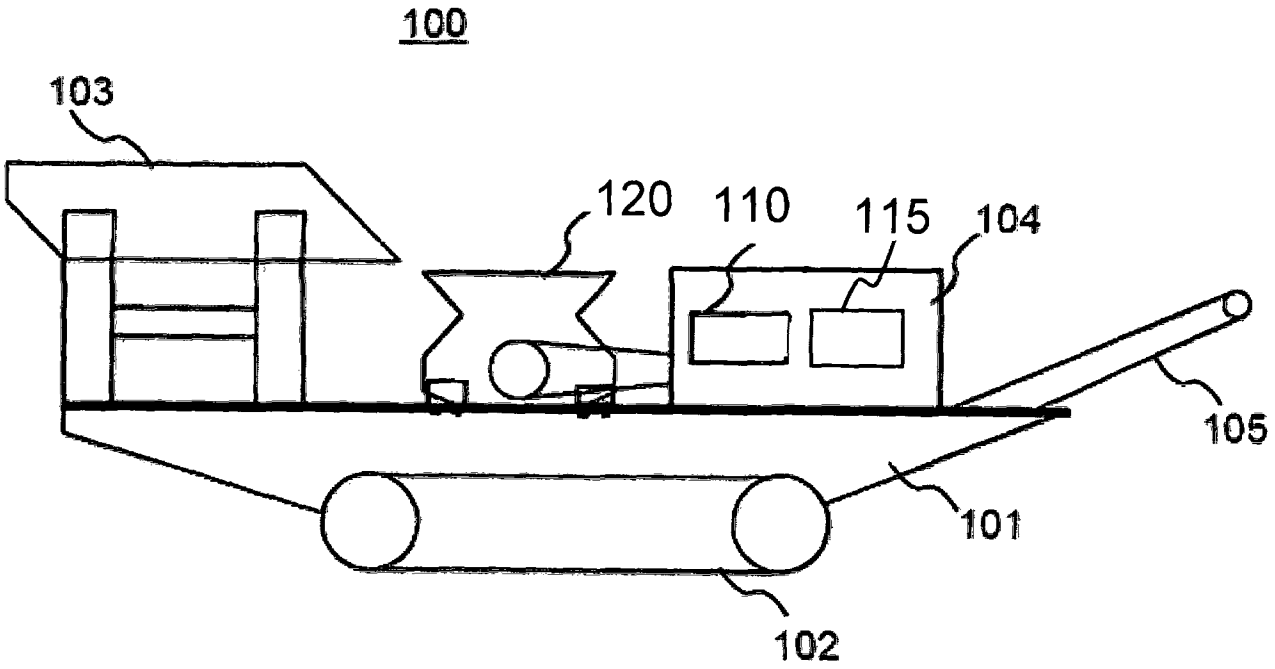
FIG. 1 shows a side view of a mineral material processing plant according to a preferred embodiment of the invention.

FIG. 1 shows a mobile track based mineral material processing plant 100 according to a preferred embodiment of the invention. Also the terms processing plant and crushing plant will be used hereinafter for the mineral material processing plant 100. Processing plant 100 comprises a frame 101, a track-base 102, a feeder 103 and a crusher 120, such as a cone-, jaw- or gyratory crusher. The crushing plant 100 further comprises a motor unit 104 for driving the crusher 120 and a conveyor for conveying the crushed material for example into a pile. The crusher 120 may be used as intermediate or post processing crusher. In particular crusher 120 may be used in fine crushing. The mobile crushing plant 100 may be movable also with other means, such as wheels, skids or legs. The crushing plant 100 may also be fixed. The feeder 103 may be of type of vibration feeder or a belt- or a lamella conveyor.

A skilled person appreciates that in addition to the elements shown in FIG. 1 the mineral material processing plant may comprise further elements, or actuators. A processing plant, according to an embodiment, that comprises a screen, for example comprises two mineral material conveyors or more mineral material conveyors for conveying the screened mineral material instead of the conveyor 105. Further, the mineral material processing plant may comprise a side conveyor, a pre-conveyor onto which conveyor a part of the mineral material arriving to be processed is transferred on the feeder.

The mineral material processing plant 100 further comprises a control system 100 with which the rpm, i.e. the rotating speed, speed per round or running speed, of a motor 104 of the mineral material processing plant 100 may be raised and lowered. The control system 110 comprises or is connected to a control system of the motor 104 from which measurement information for example on the load and running speed of the motor 104 is received.

The mineral material processing plant 100 further comprises an arrangement 115 for controlling the volume flow of hydraulics. As the running speed of the motor 104 decreases, also the running speeds of the hydraulic pumps of the mineral material processing plant decrease, at which time the volume flow produced by them decreases. In order for at least predetermined actuators being able to work substantially with their normal speed also with a reduced running speed of the motor, the volume flow of the hydraulics is increased as needed. In a preferred embodiment the arrangement 115 comprises for example a variable-capacity motor for driving the crusher 120 or screen with reduced running speed of the motor 104. Further, according to a preferred embodiment, the sufficiency of the volume flow of the hydraulics may be ascertained by using a hydraulic pump or pumps that have been dimensioned in such a way that the volume flow produced by them is sufficient also with a reduced running speed of the motor 104.

A skilled person appreciates that the actuators of the mineral material processing plant may instead of hydraulic driving be driven with a further arrangement clear to the skilled person, for example with belt drive. In such a case, according to an embodiment of the invention, when the running speed of the motor 104 decreases, the remaining in running of the actuators with substantially normal speed, i.e. process speed, is ensured with a further adjustable drive, such as a variator or an electric drive with a frequency converter. According to a preferred embodiment of the invention, the control system 110 comprises an arrangement with which the running speed of the motor 104 of the mineral material processing plant 100 is controlled automatically and continuously in a manner described hereinafter. Further, according to a preferred embodiment, the running speed of the motor 104 of the mineral material processing plant may be controlled manually.

Figure 2:
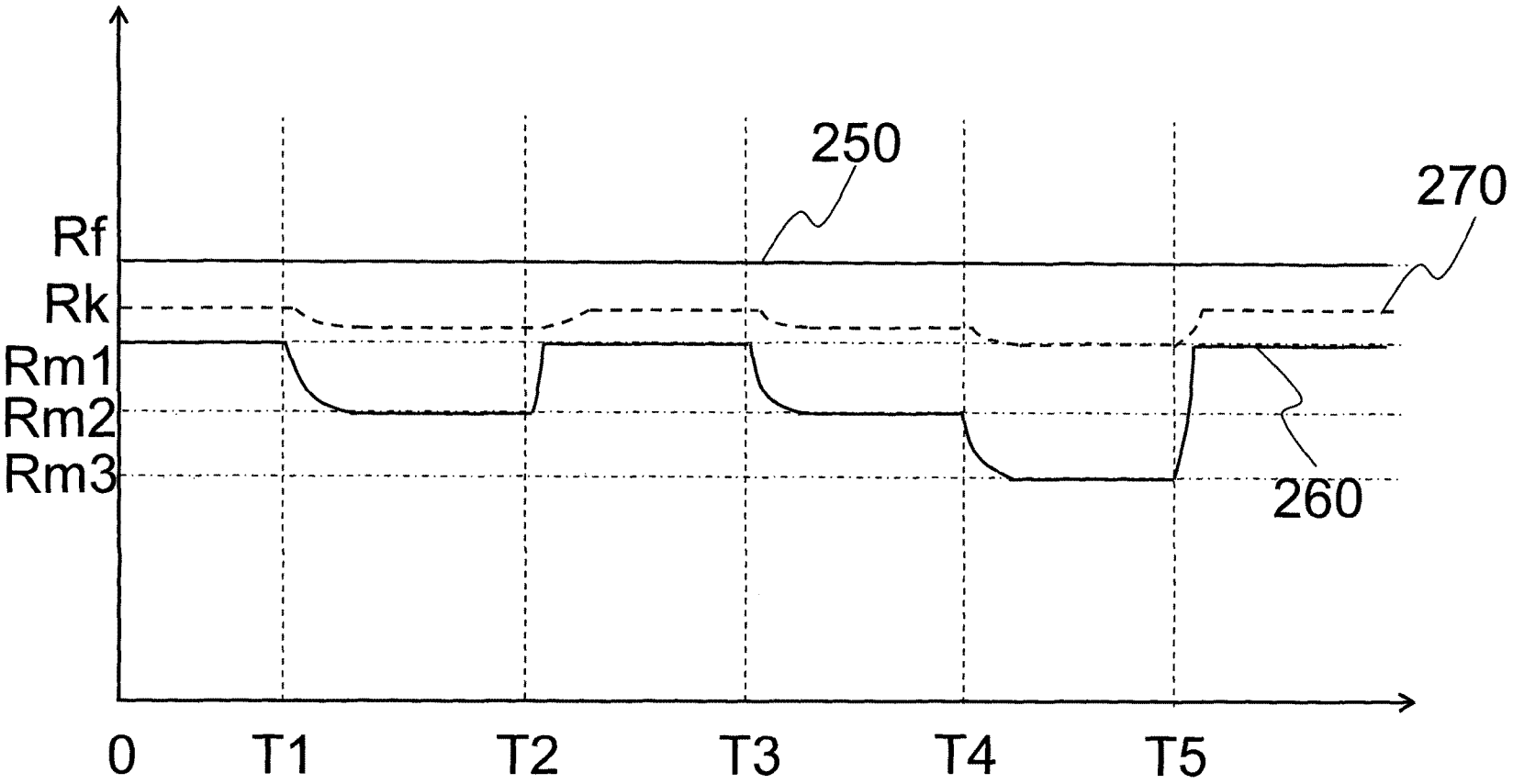
FIG. 2 shows the functioning of actuators of a mineral material processing plant according to a preferred embodiment of the invention with rotating speed.

FIG. 2 shows the functioning of actuators of a mineral material processing 100 plant according to a preferred embodiment of the invention with rotating speed 260 of the motor(s). The Fig. shows with a chart the continuous control of the mineral material processing plant 100 from a state in which the motor 104 rotates with full speed Rm1, to a lightened process state in which the running speed of the motor has been reduced in way of an example to speeds Rm2 and Rm3. The Fig. shows the running speed 250 of the crusher 120, or screen, which stays substantially same at process speed Rf also with reduced running speeds of the motor 104. Further, the Fig. shows in way of an example the running speed 270 of some further actuators, for example predetermined conveyors, which according to a preferred embodiment changes in response to the changes, i.e. reduction or increase, in running speed of the motor 104, while the running speed of the crusher remains substantially same. FIG. 2 shows in a way of an example the reduction of the running speed of predetermined actuators, for example of a side conveyor and the conveyor 105. A skilled person appreciates that the running speed 270 while changing in response to the changes of the running speed of the motor 104 does not necessarily follow precisely, for example with the same relative change, the running speed of the motor but is dependent on the respective composition and usage situation of the mineral material processing plant 100.

The vertical axis of the chart of FIG. 2 shows the running speed of the motor and actuator or actuators, and the horizontal axis shows time.

During the time period 0 . . . T1 the mineral material processing plant functions in a normal process state, i.e. the motor 104 used to drive the mineral material processing plant 100 runs with full running speed Rm1 and the crusher 120, or screen, runs with functioning speed, or process speed Rf. Also the further actuators run with full functioning speed Rk. The functioning of the time period 0 . . . T1 corresponds to a functioning state of the mineral material processing plant 100, in which the crusher 120, or screen, functions with a full capacity and the load, or load level, of the motor 104 is high.

While using the mineral material processing plant 100 situations arise in which the load of the motor 104 is low, which means that the motor 104 utilizes only a part of the power produced with the processing speed in use. In this kind of situation, the used running speed of the motor may be reduced according to an embodiment closer to a speed of peak torque offered by the motor 104. Further, according to a preferred embodiment, the running speed is reduced to a running speed different from the speed of peak torque offered by the motor 104. When reducing the running speed the fuel consumption is reduced and the operating efficiency of the motor 104 may be increased. Usage situations in which the running speed of the motor may be reduced, i.e. there may be a shift to a so called light-process state, arise in situations of small load of the mineral material processing plant 100. Situations of small load may arise for example due to less material than full capacity being fed to the crusher 120 or, screen or due to the mineral material to be processed being easy to process. Also hard to process mineral material, for example recycled material comprising uncrushable material may lead to a situation in which the crusher 120, or screen, can be fed less than at full capacity, at which time the running speed of the motor 104 may be reduced.

According to a preferred embodiment, the situations of low load are recognized by measuring the amount and or quality of the material to be processed, or change in the amount and/or quality of the material to be processed on the feeder device or on the working machine feeding the processing plant. According to a preferred embodiment, the material on the feeder device is measured with a surface gauge, for example with an ultrasound sensor, an optical sensor and/or a radiation sensor or the like. Further, according to a preferred embodiment, the amount of material may be measured by measuring the tension, force and/or pressure caused to the feeder device for example with conveyor scale, strain gauges or the like. Further, according to a preferred embodiment, the amount and/or quality of the material on the feeder device may be recognized from a video image or the like with image based measurement. A skilled person appreciates that a further common measurement arrangement and/or a combination of several different measurement arrangements may be used to recognize the material on the feeding device. The recognition- or measurement information received from the feeding device is relayed to the control system 110 that in response to the measurement starts changing the running speed of the motor.

According to a preferred embodiment, the amount and/or quality of the material to be processed may be recognized by utilizing information material arriving to be processed available in the control system 110. A mineral material processing plant may for example comprise several crushers and/or screens in which case according to a preferred embodiment, measurement information from a previous processing phase is used to recognize the amount and/or quality of the material arriving to be processed, for example measurement information on the amount of material from a pre-crusher arriving to the next process phase. Further, according to a preferred embodiment, measurement information on material flows of different processing phases of the mineral material processing plant is used to recognize the mount and/or quality of the material arriving to be processed. According to a preferred embodiment, information on volume flow and mass of the material is received at the control system 110, at which time an estimate on the quality of the material to be fed is also formed.

Prior to time T1 a measurement or recognition information has been received at the control system from the feeder device on the reduction of the amount of the material arriving to be processed or information that the material arriving to be processed is easy to process, at which time the control system 110 starts in response to the measurement information a process for changing the running speed of the motor. The process for changing the running speed of the motor is more precisely described hereinafter in connection with FIG. 3. At the time T1 it is based on the load information received at the control system 110 from the motor that the load of the motor 104 is low, at which time the running speed of the motor in response to this recognition is automatically reduced to speed Rm2. According to a preferred embodiment, the running speed is reduced in steps so that there are on or more possible reduced speeds. Further, according to a preferred embodiment, the running speed of the motor 104 is reduced steplessly. During the time period T1 . . . T2 the running speed of the motor 104 is reduced to speed Rm2. Crusher 120, or screen, runs independent on the running speed of the motor 104 with a substantially unchanged functioning speed Rf, so that the capacity of the crusher, or screen, remains. The running speed of further actuators, such as conveyors either remains at the level Rk and/or the running speed of predetermined actuators is reduced as hereinbefore described, which has no substantial effect in the functioning of the mineral material processing plant. For example a reduction of the running speed of a conveyor may somewhat increase the amount of material on the conveyor, but his has no substantial effect on the functioning of the mineral material processing plant 100 Reducing the speed of a conveyor reduces the wear of the conveyor and parts thereof, reduces the energy consumption of the mineral material processing plant 100, and reduces the amount of noise produced by the mineral material processing plant.

Prior to time T2 a measurement or recognition information has been received at the control system from the feeder device on the increase of the amount of the material arriving to be processed or information that the material arriving to be processed is hard to process, at which time the control system 110 starts in response to the measurement information a process for changing the running speed of the motor. At the time T2 it is recognized that the load of the motor 104 is increasing and the running speed of the motor 104 in response to this recognition is automatically increased to full speed Rfm1. During the time period T2 . . . T3 the mineral material processing plant 100 operates in process mode.

Prior to time T3 a measurement or recognition information has been received at the control system as hereinbefore described from the feeder device on the reduction of the amount of the material arriving to be processed or information that the material arriving to be processed is easy to process, at which time the control system 110 starts in response to the measurement information a process for changing the running speed of the motor. At the time T3 it is based on the load information received at the control system 110 from the motor that the load of the motor 104 is low, at which time the running speed of the motor in response to this recognition is automatically reduced to speed Rm2. During the time period T3 . . . T4 the running speed of the motor 104 is reduced to speed Rm2. Crusher 120, or screen, runs independent on the running speed of the motor 104 with a substantially unchanged functioning speed Rf, so that the capacity of the crusher, or screen, remains. The running speed of further actuators, such as conveyors either remains at the level Rk and/or the running speed of predetermined actuators is reduced as hereinbefore described, which has no substantial effect in the functioning of the mineral material processing plant.

Prior to time T4 a measurement or recognition information has been again received at the control system as hereinbefore described from the feeder device on the reduction of the amount of the material arriving to be processed or information that the material arriving to be processed is easy to process, at which time the control system 110 starts in response to the measurement information a process for changing the running speed of the motor. According to a preferred embodiment, after the control system has started the process for changing the running speed of the motor, the process continued for a predetermined time without receiving new measurement information on the amount and/or quality of the material arriving to be processed. At the time T4 it is based on the load information received at the control system 110 from the motor that the load of the motor 104 is still low, at which time the running speed of the motor in response to this recognition is automatically further reduced to speed Rm3. During the time period T4 . . . T5 the running speed of the motor 104 is reduced to speed Rm3. Crusher 120, or screen, runs independent on the running speed of the motor 104 with a substantially unchanged functioning speed Rf, so that the capacity of the crusher, or screen, remains. The running speed of further actuators, such as conveyors either remains at the level Rk and/or the running speed of predetermined actuators is further reduced as hereinbefore described, which has no substantial effect in the functioning of the mineral material processing plant.

Prior to time T2 a measurement or recognition information has been received at the control system from the feeder device on the increase of the amount of the material arriving to be processed or information that the material arriving to be processed is hard to process, at which time the control system 110 starts in response to the measurement information a process for changing the running speed of the motor. At the time T5 it is recognized that the load of the motor 104 is increasing and the running speed of the motor 104 in response to this recognition is automatically increased to full speed Rf. From the time T5 onwards the mineral material processing plant 100 operates in process mode. According to a preferred embodiment, the running speed of the motor 104 is not increased directly to full speed Rm1 but depending on the load to a lower speed, for example the running speed Rm2

Figure 3:
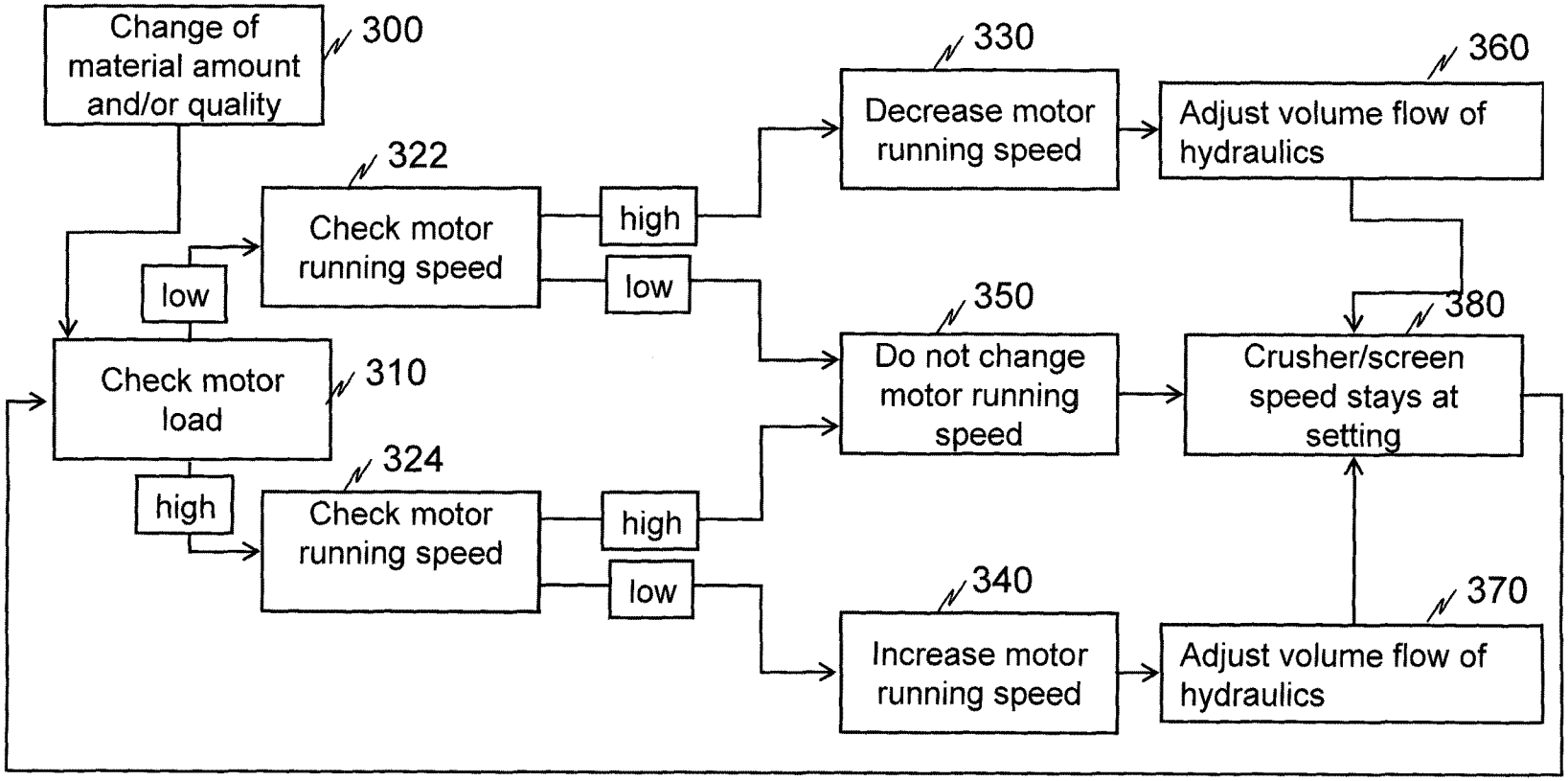
FIG. 3 shows a flow chart of a method according to a preferred embodiment of the invention.

FIG. 3 shows a flow chart of a method according to a preferred embodiment of the invention. The Fig. describes principally a continuous control carried out with arrangements that are a part of the control system 110 or connected thereto. The control shown in FIG. 3 starts at step 300 in response to detecting a change in the amount and/or quality of the material being fed as hereinbefore described.

At step 310, the load of the motor 104, in a preferred embodiment of a diesel motor, is checked. The load information is received for example from the control system of the motor which is a part of the controls system 110 of the mineral material processing plant 100 or connected thereto. According to a preferred embodiment, a predetermined threshold value or values have been set in the control system 110 with which the load of the motor is compared. Depending on the relation of the load of the motor 104 to the threshold values, it is determined that the load is either low or high. According to a preferred embodiment, more than two levels, on which the load may be found to lie, may be used in checking the load of the motor depending on the number of predetermined threshold values.

When the load of the motor 104 is low, at step 322 the running speed of the motor 104 is checked. The running speed is received for example from the control system of the motor which is a part of the controls system 110 of the mineral material processing plant 100 or connected thereto. According to a preferred embodiment, a predetermined threshold value or values have been set in the control system 110 with which the running speed of the motor is compared. Depending on the relation of the running speed of the motor 104 to the threshold values, it is determined that the running speed is either low or high. According to a preferred embodiment, more than two levels, on which the running speed may be found to lie, may be used in checking the running speed of the motor depending on the number of predetermined threshold values.

When the load of the motor 104 is low and the running speed high, the running speed of the motor is reduced at step 330 and the volume flow of the hydraulics is adjusted as needed at step 360—for example by decreasing the angle of the variable-capacity motor—so that the running speed of the crusher 120, or screen, remains substantially at the operating speed Rf and the running speed of further actuators remains at operating speed and/or the running speed of predetermined actuators, for example conveyors, is reduced in a way that does not affect the operation of the mineral material processing plant 100 as hereinbefore described.

Moottorin 104 kuormituksen ollessa matala ja kierrosnopeuden ollessa matala todetaan askeleessa 350, ettei moottorin 104 kierrosnopeutta muuteta ja murskaimen 120, tai seulan, kierrosnopeus pysyy merkittävästi toimintanopeudessa Rf.

When the load of the motor 104 is high, the running speed of the motor is checked at step 324 as described in connection with step 322.

When the load of the motor 104 is high and the running speed low, the running speed of the motor is increased at step 340 and the volume flow of the hydraulics is adjusted as needed at step 360—for example by increasing the angle of the variable-capacity motor—so that the running speed of the crusher 120, or screen, remains substantially at the operating speed Rf and the running speed of further actuators remains at operating speed and/or raises nearer to the operating speed.

When the load of the motor 104 is low and the running speed is low, it is decided at step 350 that the running speed of the motor 104 is not changed and the running speed of the crusher 120, or screen, remains substantially at the operating speed Rf.

According to a preferred embodiment, running speeds with which the motor 104 is driven have been predetermined in the control system 110. Alternatively, the running speed may be changed continuously steplessly according to the situation. Further, according to a preferred embodiment, the control system 110 is configured to control the running speed of the motor in such a way that the running speed is not constantly changed, i.e. the control is for example configured to comprise a predetermined delay prior to reacting to a reduction of the load of the motor. This is able to prevent the control from going back and forth, i.e. the running speed changing back and forth as the load varies. Further, according to a preferred embodiment, the control system 110 is configured to increase the running speed of the motor 104 in response to the load of the motor 104 increasing without delay so as to avoid for example blocking of the crusher.

Without in any way limiting the scope of protection, interpretation or possible applications of the invention, a technical advantage of different embodiments of the invention may be considered to be a decrease of energy consumption and noise production of a mineral material processing plant. Further, a technical advantage of different embodiments of the invention may be considered to be a lengthening of the lifetime of components of a mineral material processing plant. Further, a technical advantage of different embodiments of the invention may be considered to be an increase of environmental friendliness of a mineral material processing plant. Further, a technical advantage of different embodiments of the invention may be considered to be increasing the number of effective usage hours of a mineral material processing plant, as the processing plant may be used cost and energy efficiently also with a smaller capacity.

The foregoing description provides non-limiting examples of some embodiments of the invention. It is clear to a person skilled in the art that the invention is not restricted to details presented, but that the invention can be implemented in other equivalent means. Some of the features of the above-disclosed embodiments may be used to advantage without the use of other features.

As such, the foregoing description shall be considered as merely illustrative of the principles of the invention, and not in limitation thereof. Hence, the scope of the invention is only restricted by the appended patent claims.

The invention claimed is:

1. A method for controlling a mineral material processing plant, characterized in that the method comprises:

recognizing a change of amount and/or quality of material arriving to be processed;

in response to the recognized change of amount and/or quality of the material arriving to be processed, recognizing the load of a motor;

in response to the recognized load of the motor, increasing or decreasing the running speed of the motor of the mineral material processing plant while the operating speed of a crusher of the mineral material processing plant is held unchanged; and as the operating speed of the crusher is held unchanged, the operating speed of at least one conveyor of mineral material changes in response to the increasing or decreasing of the running speed of the motor.

2. The method according to claim 1, characterized in that the running speed of the motor is decreased or increased in steps.

3. The method according to claim 1, characterized in that the running speed of the motor is decreased or increased to a predetermined running speed steplessly.

4. The method according to claim 1, characterized in that the running speed of the motor is decreased or increased to a predetermined running speed.

5. The method according to claim 1, characterized in that the operating speed of the crusher is held unchanged by ascertaining a sufficient volume flow of hydraulics to the crusher.

6. The method according to claim 5, characterized in that the sufficient volume flow of hydraulics to the crusher is ascertained with a variable-capacity motor or with a pump.

7. The method according to claim 1, characterized in that said recognizing the load of the motor is carried out automatically and/or continuously.

8. A mineral material processing plant comprising:

at least one motor;

at least one crusher; and a control system;

characterized in that the mineral material processing plant further comprises an arrangement for recognizing a change of amount and/or quality of material arriving to be processed;

wherein the control system is operable to increase or decrease the running speed of the motor based on a recognized load on the motor and/or the change in the amount and/or quality of material arriving to be processed;

an arrangement for holding the operating speed of the crusher unchanged as the running speed of the motor is increased or decreased; and an arrangement for changing the operating speed of at least one conveyor of mineral material in response to increasing or decreasing the running speed of the motor at the same time as the operating speed of the crusher is held unchanged.

9. The mineral material processing plant according to claim 8, characterized in that the mineral material processing plant is one of a fixed plant, a track-based plant, and a wheel-based plant.

10. The mineral material processing plant according to claim 8, characterized in that the arrangement for holding the operating speed of the crusher unchanged comprises an arrangement for ascertaining a sufficient volume flow of hydraulics to said crusher.

11. The mineral material processing plant according to claim 10, characterized in that the arrangement for holding the operating speed of the crusher unchanged comprises a variable-capacity motor or a pump.

* * * * *